US005451462A

United States Patent [19]

Taniguchi et al.

[11] Patent Number: 5,451,462

[45] Date of Patent: Sep. 19, 1995

[54] POLYPROPYLENE CONJUGATE FIBER

[75] Inventors: Masahiko Taniguchi; Yoshimi Tujiyama, both of Moriyama, Japan

[73] Assignee: Chisso Corporation, Osaka, Japan

[21] Appl. No.: 224,146

[22] Filed: Apr. 7, 1994

[51] Int. Cl.[6] ..... D02G 3/00

[52] U.S. Cl. ..... 428/373; 428/370; 428/374; 428/394

[58] Field of Search ..... 428/364, 373, 374, 370, 428/369, 392, 394

[56] References Cited

U.S. PATENT DOCUMENTS 4,211,819 7/1980 Kunimune et al. ..... 428/374

4,814,032 3/1989 Taniguchi et al. ..... 156/167

*Primary Examiner*—N. Edwards

*Attorney, Agent, or Firm*—Fay, Sharpe, Beall, Fagan, Minnich & McKee

[57] ABSTRACT

A polypropylene conjugate fiber is provided which is suitable to a broad temperature range of hot roll processing to easily produce a non-woven fabric having a high tenacity and a good feel. The fiber comprises as a first component, a crystalline polypropylene having an isotactic pentad ratio of 0.930 or less and as a second component, a crystalline polypropylene having an isotactic pentad ratio of 0.945 or more. The first component is arranged so as to occupy 80% or more of the fiber surface, and the crystallinity of the fiber determined by X-ray diffraction is 30 to 50%.

1 Claim, No Drawings

POLYPROPYLENE CONJUGATE FIBER

BACKGROUND OF THE INVENTION

1. Field of the Invention

This invention relates to a polypropylene conjugate fiber having superior properties suitable to hot roll processing, as a raw material for a hot-melt adhesive polypropylene non-woven fabric.

2. Description of the Related Art

Hot-melt adhesive non-woven fabrics have been widely used in view of advantages of facilities, economy and hygienics due to the fact that no binder is required. Among the fabrics, since polyolefin non-woven fabrics are superior in the properties and economy, they have been used in many fields such as medical or hygienic materials such as for surgical gown, cover stock of diapers and sanitary napkins, etc., civil engineering materials, agricultural materials, industrial materials, etc., and as the raw materials for these materials, polypropylene fibers or polyethylene/polypropylene conjugate fibers have been used.

The process for producing hot-melt adhesive non-woven fabrics are classified into air-through process using hot air and hot roll process. The air-through process is suitably applied to polyethylene/polypropylene conjugate fibers. Non-woven fabrics according to the air-through process have a good tenacity and are soft, but as compared with the non-woven fabric according to hot roll process, have such drawbacks that the processing speed is so slow that the productivity is inferior and since polyethylene/polypropylene conjugate fibers are used, there is a waxy feeling specific of polyethylene.

Whereas, the hot roll process has such advantages that the processing speed is so rapid that it is advantageous in the aspect of productivity, and due to adhesion by way of hot press adhesion, even in the case of polypropylene fibers, it is possible to make up the fibers into non-woven fabrics.

Non-woven fabrics consisting of polypropylene fiber do not use polyethylene; hence the fabrics have an advantage of non-waxy feeling, but when the fabrics are produced according to hot roll process, the bonded points of the fibers become a film-form due to heat and pressure and fibers other than those at the bonded points are also compacted. As a result, there occurs a drawback that the hand of the obtained non-woven fabrics become inferior. If a low temperature or a low pressure is applied in order to prevent the hand from deterioration, the tenacity of the resulting non-woven fabrics is liable to be insufficient due to inferior adhesion. Thus, due to a small difference in the processing temperature, the tenacity becomes low or the hand becomes hard; hence conditions for producing a polypropylene non-woven fabric having a high tenacity and a soft feeling have been limited to very narrow ranges. Thus, development of a polypropylene fibers capable of obtaining a polypropylene non-woven fabric being soft and having a high tenacity, and having a broad width of processing temperature and suitable to hot roll process, has been long awaited.

As a polypropylene fiber suitable to hot roll process, Japanese patent application laid-open No. Sho 62-156310 discloses a polypropylene fiber consisting of an ethylene-propylene random copolymer having a softening point of 132° C. or lower and containing a definite quantity of ethylene. However, this fiber has drawbacks that a non-woven fabric consisting of the fiber has a hard hand and the processing temperature range within which a non-woven fabric having a tenacity and a hand suitable to practical uses can be produced is very narrow.

Further, Japanese patent application laid-open No. Hei 2-112456 discloses a non-woven fabric consisting of low stereoregular polypropylene fiber having a specified isotactic pentad ratio. This non-woven fabric has a good hand but its tenacity is insufficient. Further, in general, such a fiber consisting of a low stereoregular polypropylene has a drawback that it has an inferior carding characteristic to raise a serious problem in the production of non-woven fabric.

Further, Japanese patent application laid-open No. Hei 2-264012 discloses a polypropylene fiber having a specified compound blended therewith, but its hand and tenacity are both insufficient.

As described above, a number of attempts of intending to provide a polypropylene non-woven fabric being superior both in the tenacity and hand have been carried out, but the properties of the produced non-woven fabric have not yet been sufficient and also the processing temperature range at the time of its production has been narrow; thus a satisfactory polypropylene fiber has not yet been developed.

SUMMARY OF THE INVENTION

The object of the present invention is to provide a superior polypropylene fiber capable of easily producing a polypropylene non-woven fabric having a high tenacity and a good hand according to hot roll processing, and yet having a broad temperature range for processing, in other word, suitable to hot roll processing.

The present inventors have made extensive research in order to achieve the above object, and as a result, have found that when a crystalline polypropylene having an isotactic pentad ratio (hereinafter abbreviated to $I_5$) of 0.930 or less as a first component and a crystalline polypropylene having an isotactic pentad ratio of 0.945 or more as a second component are arranged so that the first component can occupy 80% or more of a fiber surface, and spun so that the crystallinity of the fiber determined according to X-ray difraction can fall within a range of 30 to 50%, then a polypropylene fiber having the claimed characteristics can be obtained, and have completed the present invention.

DETAILED DESCRIPTION OF PREFERRED EMBODIMENTS

The crystalline polypropylene used as the first component of the conjugate fiber in the present invention should have an isotactic pentad ratio of 0.930 or less. If the isotactic pentad ratio exceeds 0.930 , the temperature range of the hot roll processing is narrowed to make the temperature control difficult.

The crystalline polypropylene used as the second component of the conjugate fiber in the present invention should have an isotactic pentad ratio of 0.945 or more. If the isotactic pentad ratio is lower than 0.945, the resulting non-woven fabric has a low tenacity. Further, the crimp-retainability of the fiber becomes inferior and the card-passing properties become inferior.

These crystalline polypropylenes may be each a polypropylene mixture obtained by blending two or more kinds of polypropylenes having different isotactic pentad ratios. In these cases, the isotactic pentad ratio of the mixture may be sufficient to be 0.930 or less in the case of the first component, and 0.945 or more in the case of the second component.

The isotactic pentad ratio referred to herein means an isotactic ratio in terms of a pentad unit in the polypropylene molecular chain measured using $^{13}C$-NMR, proposed by A. Zambelli et al in Macromolecules, 6. 925 (1973). Namely, the isotactic pentad ratio refers to a ratio of a polypropylene unit wherein five continued propylene monomer units are isotactically bonded. The assignment of peaks in the above NMR measurement has been based upon Macromolecules, 8. 687 (1975).

The crystalline polypropylene used in the present invention can be obtained for example according to the following process:

Propylene is polymerized in two stages or more, according to slurry polymerization carried out in an inert solvent, bulk polymerization using propylene itself as solvent or gas phase polymerization composed mainly of propylene gas, in the presence of the so-called Ziegler Natta catalyst, obtained by combining a Ti-containing solid component (a solid compound composed mainly of $TiCl_3$ or a solid compound having $TiCl_4$, supported on a carrier such as $MgCl_2$) with an organoaluminum compound or in case, combining the above components further with an electron donor component as a third component.

In the present invention, the first component should occupy 80% or more of the fiber surface. If the fiber surface occupation percentage of the first component is less than 80%, the tenacity of the resulting non-woven fabric became lower and its hand became hard.

The fiber crystallinity determined according to X-ray broad angle diffraction should fall within a range of 30 to 50%. If the fiber crystallinity is less than 30% or exceeds 50%, the tenacity of the resulting non-woven fabric became low and its hand became hard, in either of the cases. As well known, the fiber crystallinity varies depending upon the tacticity of the raw material polypropylene, the spinning temperature, the stretching temperature, the stretching ratio, the annealing temperature, the annealing time, etc., and the crystallinity of usual polypropylene fibers is about 50 to 60%. Thus, in order to obtain a fiber crystallinity falling within a range of 30 to 50%, a high spinning temperature, a low stretching temperature, a low stretching ratio, a mild annealing condition, etc. may be adequately combined together, besides the choice of the raw material.

It is possible to add to the polypropylene conjugate fiber of the present invention, various kinds of additives conventionally used for polypropylene fibers such as light stabilizer, slipping agent, antistatic agent, pigment, etc., within a range of quantity not damaging the object of the present invention.

The present invention will be in more described detail by way of Examples, but it should not be constructed to be limited thereto. In addition, various values of physical properties in Examples and Comparative examples were measured according to the following methods:

Melt flow rate (MFR):

Measured according to condition (L) of ASTM D 1238.

Crystallinity of fiber:

Measured by broad angle X-ray diffraction apparatus JDX-8200T type manufactured by Nippon Denshi Co., Ltd. Ray source: Cuk$\alpha$ ray. Output: 50KV-150 mA. Scanning speed: 1°/min. in $2\theta=5°-35°$. Receiving slit: 0.2 mm.

Card-passing properties:

When a fiber is carded at a rate of 20 m/min. by means of a roller carding machine, a fiber passing all of the following three items (1) to (3) was judged to be "good", and a fiber not passing even one item among them was judged to be "inferior".

(1) No sinking of fiber into cylinder is observed.

(2) No unevenness is observed in the case where the resulting web is inspected by naked eyes.

(3) All of the basis weights of test pieces of 25 cm square collected from ten optional parts of the resulting web fall within a range of ±15% of the average values.

Tenacity of non-woven fabric:

A test piece of 5 cm long and 15 cm wide was cut off from a non-woven fabric prepared by controlling the softness so as to give 30 mm and having a basis weight of 20 g/m$^2$, followed by measuring the break strength of the test piece under conditions of a gripping distance of the test piece of 10 cm and a rate of drawing of 100 mm/min. by means of a tensile tester.

Softness:

Measured according to JIS L1018.6, item 21A. Namely, a non-woven fabric (test piece) of 5 cm long and 15 cm wide cut out from a non-woven fabric having a basis weight of 20 g/m$^2$ is placed on a horizontal base of a cantilever type tester (having an inclined plane of 45° on one side thereof, and having a smooth surface and further having a graduated scale) so that the test piece can fit the scale followed by manually and slowly feeding and sliding the test piece toward the direction of the inclined plane and reading the fed length in terms of mm unit in which the end of the test piece contacted with the inclined plane, to render the numeral value as the index of the softness. The smaller the value, the better the softness of the non-woven fabric.

Processing temperature range:

This refers to a temperature range of hot roll in the case where a non-woven fabric having a softness of 30 mm or less and a tenacity of 0.6 Kg/5 cm or higher is obtained. For example, if a non-woven fabric satisfying the conditions is obtained in the range of 130° to 140° C., the processing temperature range is 10° C.

Examples 1-3 and Comparative examples 1 and 2

A sheath-and-core type conjugate fiber was obtained by melt-spinning at a spinning temperature of 280° C., using the first component and the second component shown in Table 1 , followed by stretching the fiber to 1.5 times the original length by means of hot rolls at 40° C., and imparting mechanical crimps by a stuffer box. The component compositions, the component ratios, the percentages of occupation of the first component on the fiber surface and the crystallinities in the respective Examples and Comparative examples are shown in Table 1.

The fiber was then carded at a rate of 20 m/min. by means of a roller carding machine to obtain a web having a basis weight of 20 g/m$^2$ followed by processing the web into a non-woven fabric by means of embossing rolls having a percentage of adhesion area of 24% at the same rate. The heating temperature of the embossing roll was set at an interval of 0.5° C. in the range of 130° to 145° C. Definite test pieces were prepared from the non-woven fabrics obtained at the respective heating temperatures, followed by measuring the tenacity of non-woven fabric and the softness thereof. From these results, the tenacity of non-woven fabric and the processing temperature range in the case where the softness was 30 mm, were sought. These values of the respective Examples and Comparative examples are shown in Table 1 together with the card-passing properties.

Comparative example 3

Example 1 was repeated except that the stretching temperature was changed to 80° C.

ter, a non-woven fabric was obtained in the same manner as in Example 1.

Comparative examples 6 and 7

Example 1 was repeated except that a single component among those indicated in Table 1 was melt-spun. A non-woven fabric was then obtained in the same manner as in Example 1.

TABLE 1

| | Example 1 | Example 2 | Example 3 | Compar. ex. 1 | Compar. ex. 2 | Compar. ex. 3 | Compar. ex. 4 | Example 4 | Compar. ex. 5 | Compar. ex. 6 | Compar. ex. 7 |
|---|---|---|---|---|---|---|---|---|---|---|---|
| First component | A | B | C | D | A | A | A | C | C | B | G |
| Second component | F | F | F | F | E | F | F | G | G | | |
| Component wt. ratio (1st/2nd) | 50/50 | 30/70 | 70/30 | 50/50 | 50/50 | 50/50 | 50/50 | 50/50 | 40/60 | — | — |
| Percentage of surface occupation of 1st component (%) | 100 | 100 | 100 | 100 | 100 | 100 | 100 | 90 | 70 | — | — |
| Fiber type | Sheath-core | Sheath-core | Sheath-core | Sheath-core | Sheath-core | Sheath-core | Sheath-core | Side by side | Side by side | Single | Single |
| Crystallinity (%) | 38 | 43 | 44 | 45 | 40 | 57 | 25 | 47 | 47 | 42 | 46 |
| Card-passing properties | Good | Good | Good | Good | Bad | Good | Bad | Good | Good | Bad | Good |
| Tenacity of non-woven fabric at softness of 30 mm (Kg/5 cm) | 0.8 | 1.2 | 1.0 | 0.9 | 0.6 | 0.5 | 0.4 | 1.0 | 0.5 | 0.7 | 0.8 |
| Processing temperature width (°C.) | 7.0 | 6.5 | 6.0 | 3.0 | 1.0 | — | — | 6.0 | — | 1.5 | 1.0 |

MFR and $I_5$ of polypropylene indicated by symbols in Table are as follows:
A: MFR = 37, $I_5$ = 0.881
B: MFR = 36, $I_5$ = 0.903
C: MFR = 35, $I_5$ = 0.921
D: MFR = 36, $I_5$ = 0.935
E: MFR = 35, $I_5$ = 0.940
F: MFR = 32, $I_5$ = 0.956
G: MFR = 36, $I_5$ = 0.960

Comparative example 4

Example 1 was repeated except that the spinning temperature was changed to 310° C.

Example 4 and Comparative example 5

A side-by-side type conjugate fiber was obtained by melt spinning at a spinning temperature of 280° C., using the first component and the second component, followed by stretching the fiber to 1.5 times the original length by means of hot rolls at 40° C. and imparting mechanical crimps by a stuffing box. The component composition, the component ratio, the percentage of occupation of the first component on the fiber surface and the crystallinity of the respective Examples and Comparative examples are shown in Table 1. Thereafter, a non-woven fabric was obtained in the same manner as in Example 1.

By subjecting the polypropylene fiber of the present invention to hot roll processing, it is possible to produce a non-woven fabric having a high tenacity and a good feeling. Further, since the fiber has a processing temperature of broad range, it is easy to produce a non-woven fabric.

What we claim is:

1. A polypropylene conjugate fiber composed of a first component and a second component, which comprises as the first component, a crystalline polypropylene having an isotactic pentad ratio of 0.930 or less, and as a second component, a crystalline polypropylene having an isotactic pentad ratio of 0.945 or more, the first component being arranged so as to occupy 80% or more of the fiber surface and the crystallinity of the fiber determined according to X-ray diffraction being 30 to 50%.

* * * * *